US005185930A

United States Patent [19]

Hamlin

[11] Patent Number: 5,185,930

[45] Date of Patent: Feb. 16, 1993

[54] FLEX-DUCT CUTTERS

[76] Inventor: Michael R. Hamlin, 666 Heather St., Ojai, Calif. 93023

[21] Appl. No.: 846,040

[22] Filed: Mar. 5, 1992

[51] Int. Cl.[5] ..... B25B 7/22

[52] U.S. Cl. ..... 30/131; 7/130; 7/133

[58] Field of Search ..... 30/131; 81/180.1, 181, 81/186, 418, 421, 422, 423, 424; 7/125, 132, 133, 134, 127, 128, 129, 130, 131

[56] References Cited

U.S. PATENT DOCUMENTS

| | | | |
|---|---|---|---|
| 304,089 | 8/1884 | Entrekin | 7/134 |
| 548,603 | 10/1895 | Brown | 7/129 |
| 1,177,302 | 3/1916 | Carski | 7/130 |
| 1,276,256 | 8/1918 | O'Reardon | 7/133 |
| 1,508,687 | 9/1924 | Gilley | 7/133 |
| 1,924,837 | 8/1933 | Crause | 7/134 |
| 2,229,263 | 1/1941 | Van Keuren | 7/133 |
| 2,590,031 | 3/1952 | Petersen | 7/133 |

*Primary Examiner*—Frank T. Yost
*Assistant Examiner*—Hwei-Siu Payer
*Attorney, Agent, or Firm*—Robert M. Sperry

[57] ABSTRACT

An improved hand tool for cutting flex-duct material comprising a plier-type wire cutter having retaining member mounted on the outside of the jaws of the wire cutter for releasably retaining a disposable razor-type blade.

4 Claims, 1 Drawing Sheet

FLEX-DUCT CUTTERS

BACKGROUND

1. Field of Invention

This invention relates to hand tools and is particularly directed to improved hand tools for cutting flex-duct material and the like.

2. Prior Art

In the heating and air conditioning industry, it is conventional practice to install a central furnace or air conditioning unit at a desired location within a house or building and to connect the central unit to outlet vents located at various remote locations about the building by means of suitable ducting. In the past, such ducting was usually formed of thin-walled aluminum or steel cylinders, which were wrapped in layers of insulating material. However, such rigid ducting was difficult and time-consuming to work with and, hence, was quite expensive. More recently, such rigid ducting has been replaced by flex-ducting, having a tube of flexible material, such as plastic or fabric, supported by a helical wire and having a layer of insulating material secured about the flexible tube. As the name suggests, the flex-duct material is quite flexible and, hence, is easy to curve about chimneys and other obstacles. However, cutting the flex-duct material to desired lengths presents some problems. The flexible tube can be cut quite easily with a cutter, such as a knife, razor blade or the like. However, the helical wire supporting the tube is quite strong and can only be severed by wire cutters or the like. Moreover, in cutting the tube with a knife or razor blade, the cutter frequently strike the wire supporting the tube, which tends to nick or dull the cutter blade. This greatly reduces the useful life of the cutter and necessitates that the user make frequent changes from the knife or razor blade to wire cutters, in order to cut the supporting wire, which involves considerable loss of time and significantly increases the labor cost of installing the flex-duct material. Numerous devices have been proposed heretofore for overcoming this problem. Thus, one recent device has been proposed comprising a plier-type tool having a knife blade fixed to one handle and wire cutter blade fixed to the other and cooperating with a second wire cutter blade formed at the base of the knife blade. This eliminates the necessity of changing from the tube cutting tool to the wire cutting tool and, hence, reduces the time required for performing a given cutting operation. However, the knife blade of this device is still subject to nicking, due to striking the supporting wire of the flex-duct, and, consequently, will rapidly become dull and will require frequent resharpening. Thus, none of the prior art devices have been entirely satisfactory.

BRIEF SUMMARY AND OBJECTS OF THE INVENTION

These disadvantages of prior art flex-duct cutting tools are overcome with the present invention an improved tool is provided having disposable tube-cutting blades which can quickly and easily be replaced, and which are mounted on plier-type wire cutters so as to provide immediate availability of the wire cutter, when needed.

The advantages of the present invention are preferably attained by providing a plier-type wire cutter having means mounted on the outside of the jaws of the wire cutter for releasably retaining a disposable razor-type blade.

Accordingly, it is an object of the present invention to provide an improved hand tool.

Another object of the present invention is to provide an improved hand tool for cutting flex-duct material.

An additional object of the present invention is to provide an improved hand tool for cutting flex-duct material which minimizes the time required for changing between a tube cutting device and a wire cutting device.

A further object of the present invention is to provide an improved hand tool for cutting flex-duct material having a replaceable blade for cutting the tube material.

A specific object of the present invention is to provide an improved hand tool for cutting flex-duct material comprising a plier-type wire cutter having means mounted on the outside of the jaws of the wire cutter for releasably retaining a disposable razor-type blade.

These and other objects and features of the present invention will be apparent from the following detailed description, taken with reference to the figures of the accompanying drawings.

DETAILED DESCRIPTION OF THE INVENTION

Figure 1:
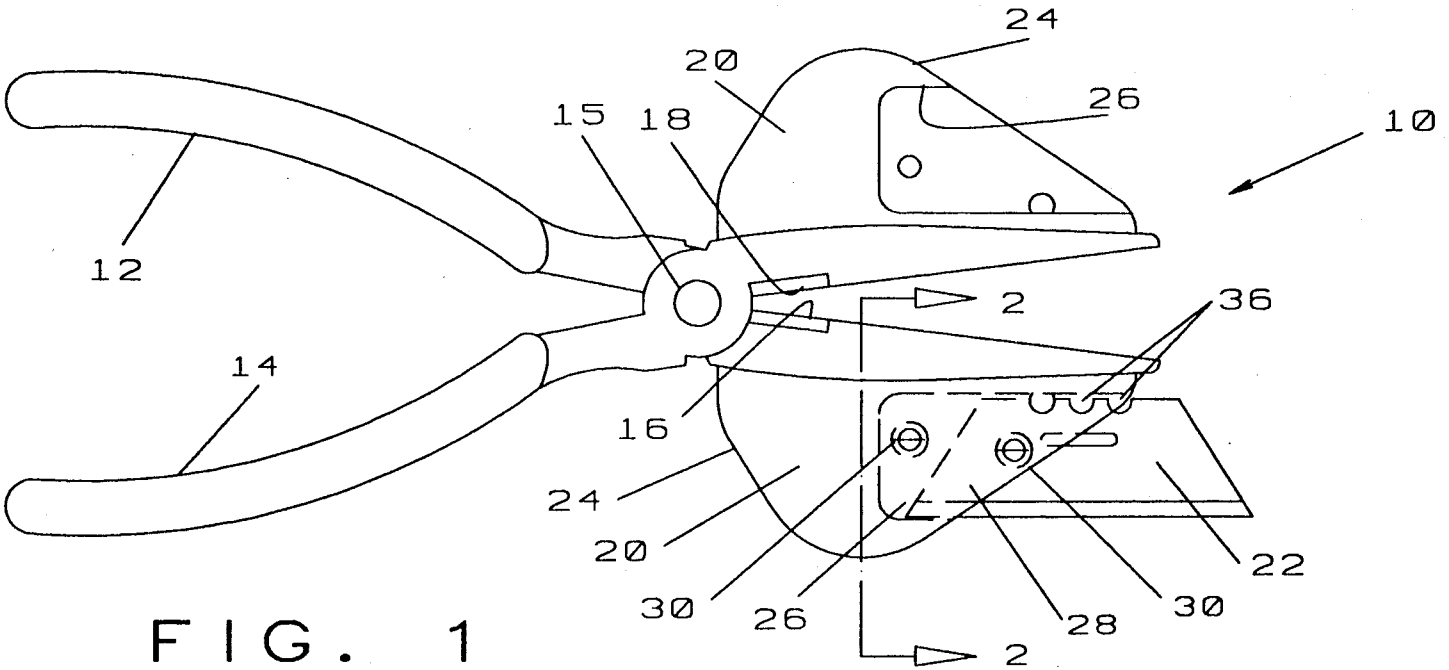
FIG. 1 is a side view of a flex-duct cutting tool embodying the present invention.
Figure 2:
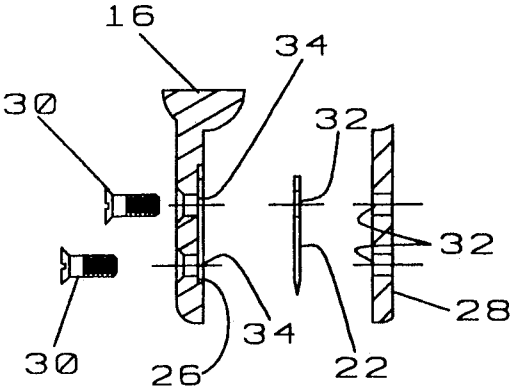
FIG. 2 is an exploded transverse section through the device of FIG. 1, taken on the line 2——2 thereof.
Figure 3:
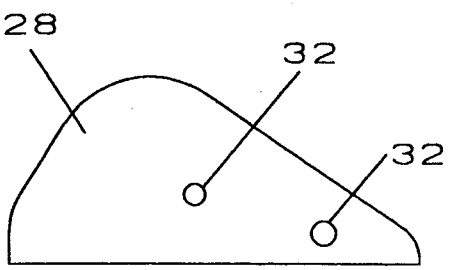
FIG. 3 is a side view of a cover plate for attaching the razor-type cutting blade of the flex-duct cutting tool of FIG. 1.

In that form of the present invention chosen for purposes of illustration in the drawings, FIG. 1 shows a cutting tool, indicated generally at 10, comprising a plier-type device having a pair of handle members 12 and 14, which are pivotally secured together by suitable means, such as pivot pin 15. Handle member 12 has a wire cutting jaw 16 formed adjacent its forward end and handle member 14 has a wire cutting jaw 18 formed adjacent its forward end and cooperating with the wire cutting jaw 16 to cut a wire, not shown, inserted between the wire cutting jaws 16 and 18. Each of the wire cutting jaws 16 and 18 has an attaching member 20 mounted on the outer surface thereof for releaseably retaining a razor-type cutting blade 22. As shown, the attaching members 20 are identical and each comprises a support member 24, which is fixedly mounted on the outer surface of the respective wire cutting jaw 16 or 18 and projects outwardly therefrom. As best seen in FIG. 2, the support members 24 are each formed with a recess 26 on one side thereof to releasably receive the razor-type cutting blade 22, together with a suitable cover plate 28, which is secured to the support member 24 by releasable fastening means, such a screws 30 which pass through suitable openings 32, formed in the razor-type cutting blade 22 and cover plate 28, to threadedly engage holes 34 in the support member 24, as seen in FIG. 2. If desired, one or both of the openings 32 in the razor-type blade 22 may be replaced by slots, as seen at 36 in FIG. 1.

In use, the razor-type blades 22 may be used to quickly and easily cut the insulating layers and the plastic or fabric tube material of a flex-duct tube. When the supporting wire of the flex-duct tube is encountered, the operator merely opens the wire cutting jaws 16 and 18, inserts the wire, not shown, between the wire cutting jaws 16 and 18 and squeezes the handles 12 and 14 together to cause the wire cutting jaws 16 and 18 to move toward each other and, hence, to cut the wire, not shown. Although the razor-type blades 22 may be nicked or dulled by striking the wire, not shown, of the flex-duct tubing, the razor-type blades 22 can be replaced, quickly and easily, by unscrewing and removing the fasteners 30 and the cover plate 28, replacing the razor-type blade 22 and replacing the cover plate 28 and fasteners 30. This replacement of the razor-type blades 22 can be accomplished in a matter of seconds and can be repeated as often as necessary or desirable. Thus, the operator can be assured of always having a sharp blade available for cutting the insulation layer and plastic or fabric tube of the flex-duct tubing and of being able to quickly and easily switch to the wire cutting jaws, when needed, for cutting the supporting wire of the flex-duct tubing without having to set down one tool and reach for another.

Obviously, numerous variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A hand tool comprising:

a plier-type tool having a pair of wire cutting jaws pivotally connected together, a razor-type blade having at least one cutting edge, and attaching means mounted on at least one of said wire cutting jaws for releasably retaining said razor-type blade with said cutting edge facing outward from said jaws.

2. The tool of claim 1 wherein said attaching means comprises:

a support member fixedly mounted on at least one of said wire cutting jaws and projecting outwardly therefrom, and means for releaseably securing said razor-type blade to said support member.

3. The tool of claim 2 further comprising:

a recess opening on one side of said support member formed to releaseably receive said blade, a cover plate cooperating in supporting said blade, and fastening means releaseably securing said cover plate and said blade to said support member.

4. The tool of claim 1 wherein:

said attaching means are provided on each of said jaws.

* * * * *